United States Patent [19]

Aubert

[11] 4,202,384

[45] May 13, 1980

[54] AUTOMATIC DEVICE FOR INSTALLING SELF-LOCKING STRAPS

[75] Inventor: René Aubert, Pont-A-Mousson, France

[73] Assignee: Societe d'Usinage des Tubes pour l'Electricite S.U.T.E., Pont-A-Mousson, France

[21] Appl. No.: 4,511

[22] Filed: Jan. 18, 1979

[30] Foreign Application Priority Data

Feb. 1, 1978 [FR] France ..... 78 02735

[51] Int. Cl.[2] ..... B21F 9/02

[52] U.S. Cl. ..... 140/123.6; 140/93.2

[58] Field of Search ..... 140/93.2, 123.6

[56] References Cited

U.S. PATENT DOCUMENTS

| | | | |
|---|---|---|---|
| 3,169,560 | 2/1965 | Caveney et al. | 140/123.6 |
| 3,610,296 | 10/1970 | Kabel | 140/123.6 |
| 3,735,784 | 5/1973 | Obuch, et al. | 140/123.6 |
| 3,931,838 | 1/1976 | Bakermans | 140/123.6 |
| 4,129,157 | 12/1978 | Sciolotto | 140/123.6 |

*Primary Examiner*—Lowell A. Larson

*Attorney, Agent, or Firm*—Sughrue, Rothwell, Mion, Zinn and Macpeak

[57] ABSTRACT

The invention relates to an automatic device for installing self-locking binder straps, said device comprising: two handles assembled so as to allow rotation relative to each other; a moving component carried by one of said handles and gripping the end of the strap in such a way that the relative movement of the handles tightens the strap; a cutter blade carried by one of said handles and operating when the strap is tightened to a predetermined extent. According to the invention the moving component which slides on a first handle has a cam portion in contact with the adjacent edge of the second handle so that moving said handles towards each other moves said moving component in translation in opposition to resilient return bias and the second handle has an actuating component for the cutter blade which is fixed to the first handle, said actuating component operating automatically when said moving component has reached a position which corresponds to the predetermined tightening of the collar due simply to the second handle bearing on the cam portion of said moving component. Application to installing binder straps when binding or performing similar operations on work sites.

12 Claims, 8 Drawing Figures

AUTOMATIC DEVICE FOR INSTALLING SELF-LOCKING STRAPS

FIELD OF THE INVENTION

The present invention relates to binding tools for installing fasteners or binding devices such as self-locking straps and it provides particularly an automatic strapping device for tightening and fixing such straps around a harness of metal wires or a bundle of like objects.

BACKGROUND OF THE INVENTION

There exist adjustable fasteners which can be adapted to a wide range of wire harnesses and although some fasteners are detachable so that they can be used again, for instance some self-locking straps are not designed to be used again once they have been fastened. The invention relates more particularly to a tool adapted to tighten and fix a non-reusable type of fastener around a harness of electric wires, for example, and then immediately to cut excess of any loose end thereof.

There are already numerous tools on the marked and they are often shaped like a pistol with a long trigger which allows the operator to tighten and cut the strap whose end has previously been inserted in the end of the tool. Some such tools provide tightening to a predetermined force, which is advantageous.

However, these devices are generally of complicated design with a mechanism which includes a plurality of articulated parts, and they do not always directly provide all the advantages of adjustment and adaptability. Some allow tightening to the required force but not cutting at the required force (cutting in a subsequent stage); others include two totally independent and non-adjustable mechanisms, one for tightening and the other for cutting; others still are more efficient and offer all possibilities of adjustment but their complicated design raises their cost price appreciably. (Such devices frequently include more than five articulation axes).

The invention aims to provide simpler tooling which is not so bulky as the prior art and which combines the advantages of adjustment and adaptability and is more efficient and has a long stroke.

SUMMARY OF THE INVENTION

The invention provides, more particularly an automatic device for installing self-locking binder straps, said device comprising: two handle assembled so as to allow rotation relative to each other; a moving component carried by one of said handles and gripping the end of the strap in such a way that the relative movement of the handles tightens the strap; a cutter blade carried by one of said handles and operating when the strap is tightened to a predetermined extent. The invention is characterized in that the moving component which slides on a first handle has a cam portion in contact with the adjacent edge of the second handle so that moving said handles towards each other moves said moving component in translation in opposition to resilient return means and in that the sacond handle has an actuating component for the cutter blade which is fixed to the first handle, said actuating component operating automatically when said moving component has reached a position which corresponds to the predetermined tightening of the collar due simply to the second handle bearing on the cam portion of said moving component.

The device of the invention may further have at least one of the following characteristics:

the cutter blade actuating component includes two side cheeks integral with the second handle and between which the first handle is disposed, each of said cheeks having a first slot through which the articulation pin of the device passes and a second slot in which there can move the end of a finger integral with the cutter blade;

the two handles are connected together by a resilient blade fixed on the second handle and whose free end supports the articulation pin of the device in the slots of the corresponding side cheeks, said pin advantageously being lined with a distance piece between the side cheeks to prevent the end of the resilient blade from bearing directly against said pin;

the second handle carries a slider through which the resilient blade passes to adjust the predetermined tightening of the strap, the operative portion of said resilient blade extending from the articulation pin of the device to said slider;

the first slot of each cheek through which the articulation pin of the device passes has a generally triangular periphery with rounded angles to allow a relative movement of the handles when cutting whatever the relative positions of said handles may be when the collar is tightened to the predetermined extent;

the second slot of each cheek through which passes the end of a finger integral with the cutter blade is oblong and curved in an arc to allow the relative rotating movement of the handles, one end of said slot forming a stop for said finger to limit the distance between said handles in the open (rest) position of the device;

the first handle has two oblong slots for the finger integral with the cutter blade to pass through, said long axis of the slots being essentially in line with the articulation pin of the device;

the cam portion of the moving component is in contact with the adjacent edges of the two handles;

at least one handle has a curved edge to promote contact of the cam portion and the translation movement of the moving component;

contact between the cam portion of the moving component and the edges of the adjacent handles is improved by means such as rollers carried by said cam portion;

the first handle is made from a channel bar whose edges are folded to co-operate with a groove of the moving component to slide said component, a compression spring being recessed in said channel bar, between said component and the free end of said handle.

Other characteristics and advantages of the invention will become more clearly apparent from the following description given by way of an illustration which has no limiting character, with reference to the figures of the accompanying drawings.

DESCRIPTION OF PREFERRED EMBODIMENTS

Figure 1:
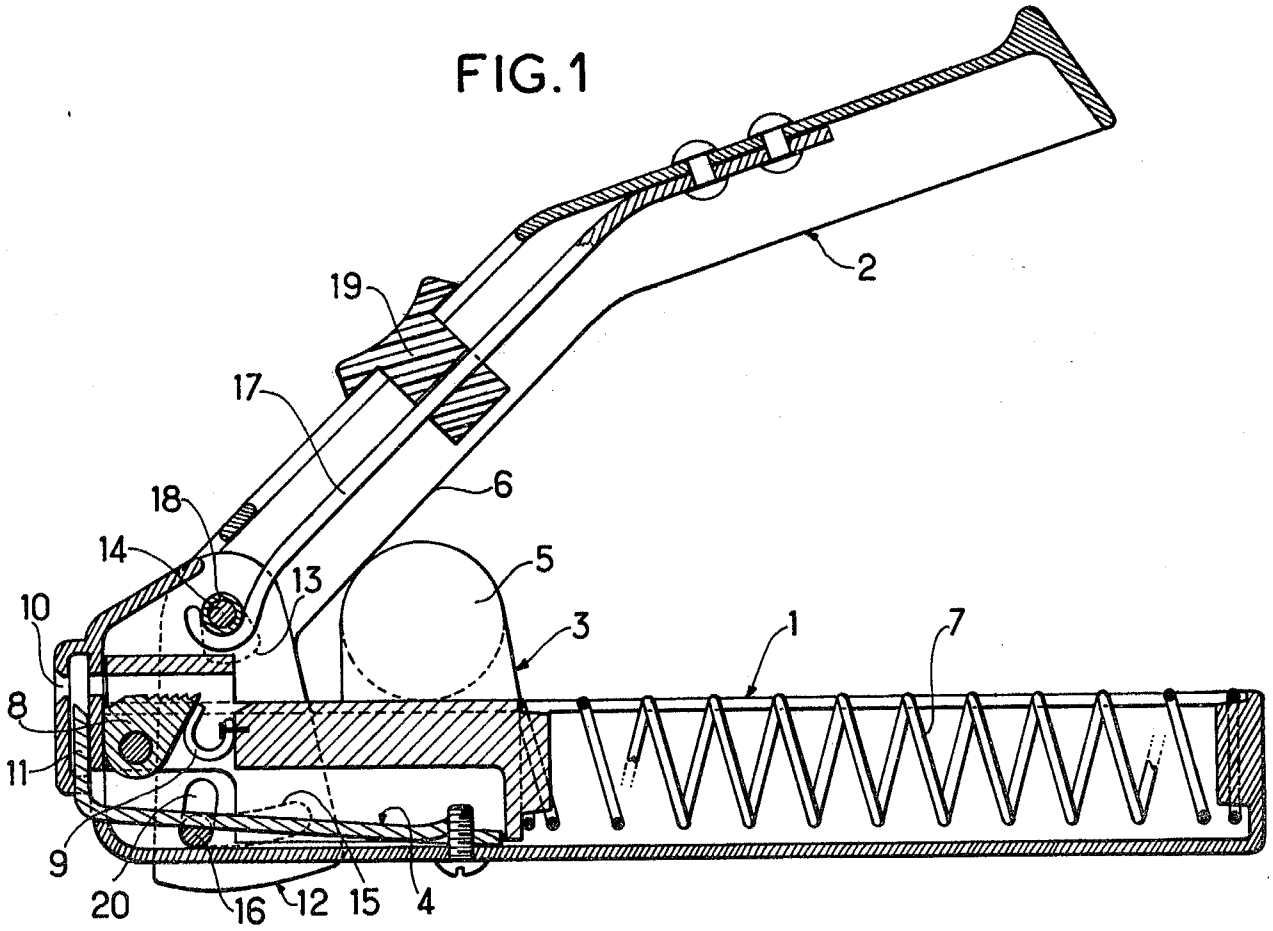
FIG. 1 is a cross-section of a device in accordance with the invention, in the rest position.

In FIG. 1, an automatic device includes two handles 1, 2 assembled for rotation relative to each other. A moving component 3 is carried by one of said handles for gripping the end of the binding strap (not shown here), so that the relative movement of the handles tightens the strap, and a cutter blade 4 carried by one of said handles operates when the strap is tightened to a predetermined extent. Up to this point, as far as concerns their functions, the components are the same as those of the prior art, but there the resemblance ends.

Indeed, in accordance with one fundamental principle of the invention, the moving component 3 which slides in the first handle 1 has a cam portion 5 in contact with the adjacent edge 6 of the second handle 2 so that when said handles are moved towards each other, said moving component is cammed to move in translation in opposition to resilient return means here constituted by a compression spring 7 in the handle 1. The second handle 2 includes an actuating component for the cutter blade which is fixed to the handle 1. Said actuating component operates automatically when said moving component has reached a position which corresponds to the predetermined tightening of the strap due to simple bearing of the handle 2 on the bearing portion 5 of said moving component.

In a way known per se the moving component 3 has a ratchet 8 which allows the end of the strap to be jammed by the action of a spring 9 (which spring could alternatively be a spiral spring lodged in a recess provided for this purpose in the ratchet). It will be observed that in the rest position (as in FIG. 1), the ratchet allows the end of the strap to be inserted through the slot 10 in the handle 1 simply by making the handle 1 abut against wall 11 of the cutter blade.

The component which actuates the cutter blade 4 fixed to the handle 1 includes two side cheeks 12 (only one of which is seen here). Said cheeks are integral with the handle 2, and the handle 1 is disposed between them. They each have a first slot 13 through which there passes the articulation pin 14 of the device and a second slot 15 in which there moves the end of a finger 16 integral with the cutter blade 4. The two handles are connected together by a resilient blade 17 fixed in the handle 2. The free end of the blade 17 supports the pin 14 in the corresponding slots 13 of the side cheeks. It is advantageous for the pin 14 to be lined with a spacer or distance piece 18 (made, for example, of bronze, nylon or teflon) between the side cheeks to prevent the end of the resilient blade 17 from bearing directly against said pin. The second handle 2 carries a movable slider 19 through which the resilient blade 17 passes to adjust the predetermined tightening of the strap, the operative portion of said blade extending from the pin 14 to said slider. This allows effective adjustment of the force.

To understand the relative movement of the handles 1, 2 when cutting, it is necessary to examine the slots provided for these movements. The slots 13 for receiving the pin 14 in each side cheek 12 have a generally triangular periphery with rounded corners to allow relative movement of the handles when cutting, whatever their relative positions may be, while the slot 15 in which the end of the finger 16 is inserted is oblong and curved in an arc to allow the relative movement of the handles, one end of said slot 15 forming a stop for said finger to limit the distance between the handles in the open (rest) position of the device. The handle 1 has two oblong slots 20 for the finger 16 to pass through, the long axis of said slots being essentially in line with the pin 14.

Figure 2:
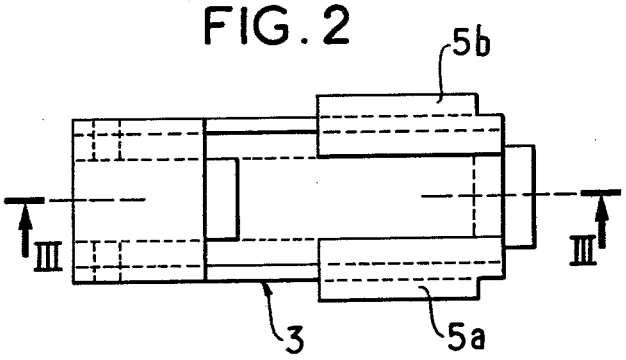
FIG. 2 is a plan view of the moving component of the device illustrated in FIG. 1, said component being designed to grip the end of the binding strap.
Figure 3:
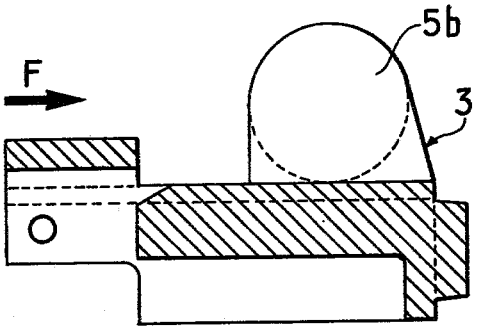
FIG. 3 is a cross-section along line III—III of FIG. 2.
Figure 4:
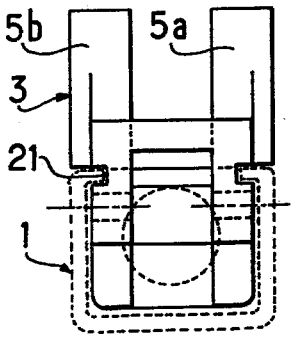
FIG. 4 is an end plan view in the direction of arrow F of FIG. 3.
Figure 5:
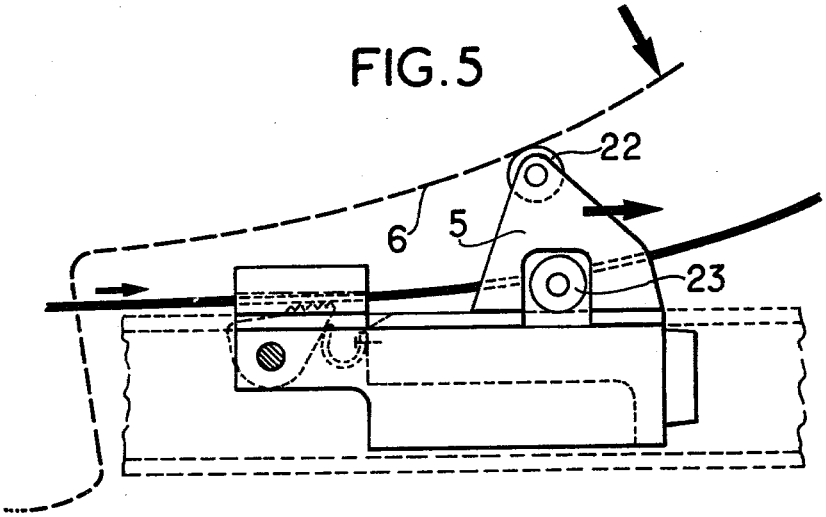
FIG. 5 is a partial vertical sectional view which illustrates a variant of the device of the invention, with rollers and curved handle edge.

In FIGS. 2 to 4, showing the moving component, it can be seen that it includes a cam portion formed by two plates 5a, 5b between which the end of the strap can pass, and two grooves 21 which co-operate with the folded edges of the channel bar which constitutes the handle 1. Therefore, the cam portion is in contact with the adjacent edges of the two handles; to improve sliding, the plates are made of a material with a low coefficient of friction such as teflon or polyvinyl chloride. Of course, numerous variants are possible with respect to both the shape of the cam portion and the shape of the camming edges of the handles: e.g. as shown in FIG. 5, the moving component carries upper, cam rollers 22 in contact with the curved edge 6 of the handle 2 and lower, guide rollers 23 in contact with the straight edge of the handle 1. These dispositions tend to promote contact and to reduce the tightening effort required.

Figure 6A:
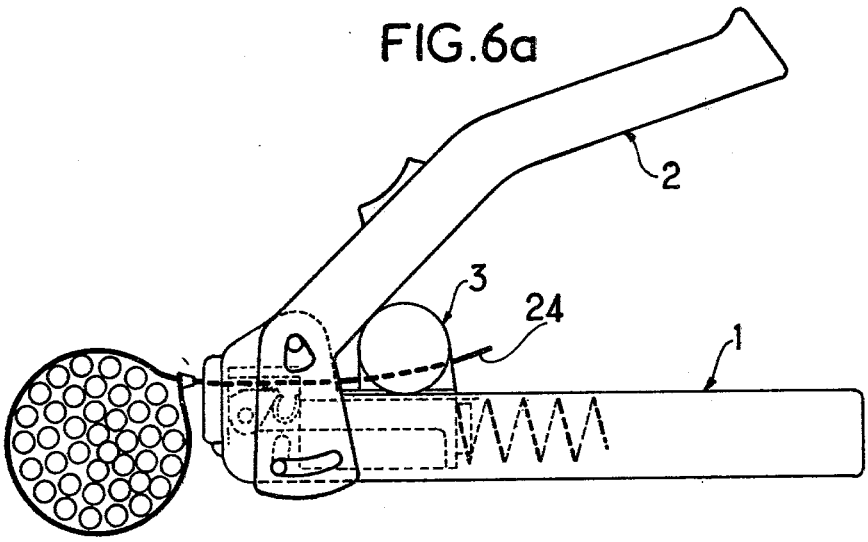
FIGS. 6a, 6b and 6c illustrate schematically the respective operation phases of the device: i.e. during installation, tightening and cutting.
Figure 6B:
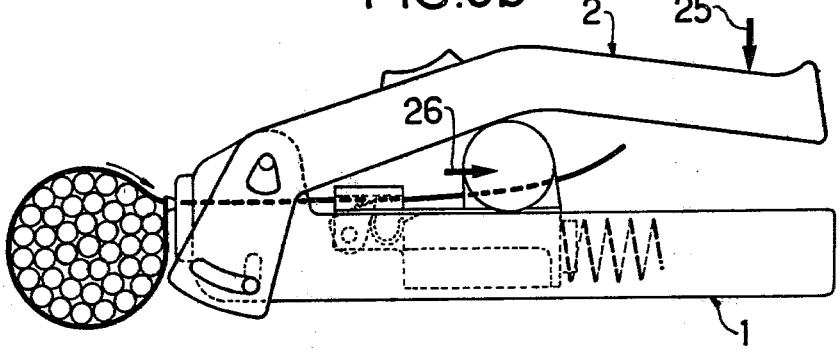
Figure 6C:
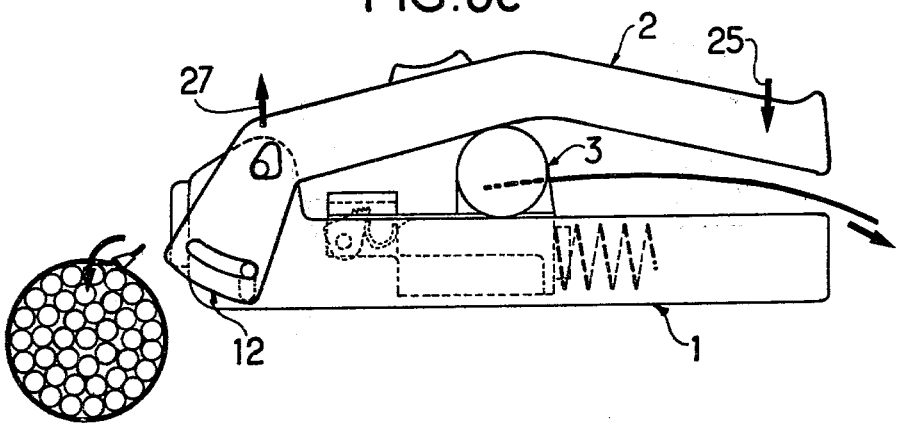

The operation of the tool is illustrated in FIGS. 6a, 6b und 6c:

FIG. 6a illustrates installation: the end 24 of a strap surrounding a wire harness is inserted through the inlet slot, while the tool is in the rest position;

FIG. 6b illustrates the tightening phase: the operator operates the handles (see arrow 25); this moves the moving component 3 in opposition to its retaining spring (see arrow 26) and pulls the end of the strap which is then held by the ratched until the strap is tightened to the predetermined extent; and FIG. 6c illustrates the cutting phase which automatically follows the tightening phase: the moving component 3 is then stationary and its cam portion acts as a fulcrum for the handle 2; this moves the opposite end of the handle 2 (side cheeks 12) in the direction of the arrow 27 and therefore moves the finger of the cutter blade, thus cutting the excess end of the collar at the force required for tightening.

As may have been observed from the description, the device of the invention is very simple and easy to operate. Plastic straps or fasteners whether self-locking or not can thereby be installed; such an operation is currently carried out when binding on work sites and provides automatic cutting of the excess end of the collar at the force required for tightening.

It is self-evident that the invention is in no way limited to the examples which have been given thereof by way of illustration, but includes all variants which resume with equivalent means the general definition of the invention such as claimed.

I claim:

1. An automatic device for installing self-locking binder straps, said device comprising: two handles, means for assembling said handles so as to allow rotation of said handles relative to each other; a moving component carried by one of said handles and gripping the end of the strap in such a way that the relative movement of the handles tightens the strap; a cutter blade carried by one of said handles for cutting operation when the strap is tightened to a predetermined extent; the improvement wherein said moving component is biased to a first position by resilient return means, said moving component which slides on a first handle has a cam portion in contact with the adjacent edge of the second handle so that said handles when moving towards each other moves said moving component in translation in opposition to said resilient return means, the second handle has an actuating component for the cutter blade which is fixed to the first handle such that said actuating component operates automatically when said moving component has reached a position which corresponds to the predetermined tightening of the collar due simply to the second handle bearing on the cam portion of said moving component.

2. A device according to claim 1, wherein the cutter blade actuating component includes two side cheeks integral with the second handle and between which the first handle is disposed, each of said cheeks having a first slot through which the articulation pin of the device passes and a second slot in which is movably mounted the end of a finger integral with the cutter blade.

3. A device according to claim 2, wherein the two handles are connected together by a resilient blade fixed on the second handle having a free end which supports the articulation pin of the device in the slots of the corresponding side cheeks.

4. A device according to claim 3, wherein the articulation pin of the device is lined with a spacer between the side cheeks to prevent the end of the resilient blade from bearing directly against said pin.

5. A device according to claim 3, wherein the second handle carries a slider through which the resilient blade passes to adjust the predetermined tightening of the strap such that the operative portion of said resilient blade extends from the articulation pin of the device to said slider.

6. A device according to claim 2, wherein the first slot of each cheek through which the articulation pin of the device passes has a generally triangular periphery with rounded corners to allow a relative movement of the handles when cutting, regardless of the relative positions of said handles when the collar is tightened to said predetermined extent.

7. A device according to claim 2, wherein the second slot of each cheek through which passes the end of a finger integral with the cutter blade is oblong and curved in an arc to allow the relative rotating movement of the handles, one end of said second slot forming a stop for said finger to limit the distance between said handles in the open position of the device.

8. A device according to claim 2, wherein the first handle has two oblong slots for the finger integral with the cutter blade to pass through, with the long axis of the slots being essentially in line with the articulation pin of the device.

9. A device according to claim 1, wherein the cam portion of the moving component is in contact with the adjacent edges of the two handles.

10. A device according to claim 9, wherein said handle in contact with the cam portion and has a curved edge to promote the translation movement of the moving component.

11. A device according to claim 9, further comprising rollers carried by said cam portion for improved contact between the cam portion of the moving component and the edges of the adjacent handle.

12. A device according to claim 1, wherein the first handle is made from a channel bar whose edges are folded and grooves are carried by the moving component to slide said component on said first handle, and a compression spring is recessed in said channel bar, between said component and a free end of said handle.

* * * * *